US007255650B2

(12) United States Patent
Braynt et al.

(10) Patent No.: US 7,255,650 B2
(45) Date of Patent: Aug. 14, 2007

(54) GOLF CLUB HEAD WITH ALIGNMENT GUIDE

(75) Inventors: Leslie J. Braynt, Peoria, AZ (US); David D. Jones, Glendale, AZ (US); Xiaojian Chen, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 127 days.

(21) Appl. No.: 11/193,103

(22) Filed: Jul. 29, 2005

(65) Prior Publication Data

US 2007/0026963 A1 Feb. 1, 2007

(51) Int. Cl.
*A63B 69/36* (2006.01)
*A63B 53/04* (2006.01)

(52) U.S. Cl. ..... 473/252; 473/340

(58) Field of Classification Search ..... 473/219–256, 473/340; D21/736–746, 751–752, 759
See application file for complete search history.

(56) References Cited

U.S. PATENT DOCUMENTS 3,880,430 A * 4/1975 McCabe ..... 473/253
3,955,819 A * 5/1976 Yokich ..... 473/252
D240,642 S * 7/1976 Manfrin ..... D21/742
D312,858 S * 12/1990 Anderson et al. ..... D21/746
5,125,664 A * 6/1992 Evans ..... 473/243
5,273,282 A * 12/1993 Cannon ..... 473/252
D410,717 S 6/1999 Anderson
6,743,112 B2 6/2004 Nelson
6,837,801 B1 1/2005 Souza
6,988,955 B2 * 1/2006 Stoakes ..... 473/242
7,001,284 B2 * 2/2006 Edel ..... 473/252
7,083,525 B2 * 8/2006 Pond et al. ..... 473/251
2003/0186756 A1 * 10/2003 Baron ..... 473/252
2004/0053703 A1 * 3/2004 Snyder ..... 473/243
2005/0192114 A1 * 9/2005 Zider et al. ..... 473/251
2006/0079343 A1 * 4/2006 Zamora ..... 473/251

* cited by examiner

*Primary Examiner*—Sebastiano Passaniti
(74) *Attorney, Agent, or Firm*—Darrell F. Marquette

(57) ABSTRACT

A golf club head has a cavity for receiving an alignment guide or insert having parallel grooves separated by parallel ridges. The club head includes a face member with a front surface arranged for impacting a golf ball. The insert is oriented such that the parallel grooves and ridges are perpendicular to the front surface of the face member. The insert provides a visual guide for aligning the club head to the intended target that is highly visible under a variety of ambient lighting conditions. The insert may be selected from a plurality of inserts having different weights.

10 Claims, 2 Drawing Sheets

GOLF CLUB HEAD WITH ALIGNMENT GUIDE

BACKGROUND OF THE INVENTION

The present invention relates generally to golf equipment and, in particular, to a golf club head with an alignment guide.

Proper alignment of golf club heads is essential for their effective use. Because golf club heads are often constructed of metal, light reflecting off these metal golf club heads may produce glare and shadows thus making sighting and aligning of the club heads difficult and inaccurate. Also, different player preferences and course conditions may require adjustment in the weight of the club head for optimum performance.

SUMMARY OF THE INVENTION

The present invention provides a golf club head including a body having a face member and a flange member extending rearwardly from the face member. The face member includes a front surface arranged for impacting a golf ball, and the flange member has an upper surface with a cavity formed therein. An alignment guide or insert disposed in the cavity in the flange member has a plurality of substantially parallel grooves separated by a ridge. The insert is oriented in the cavity so that the grooves and the ridge are perpendicular to the face member front surface.

DESCRIPTION OF THE INVENTION

Figure 1:
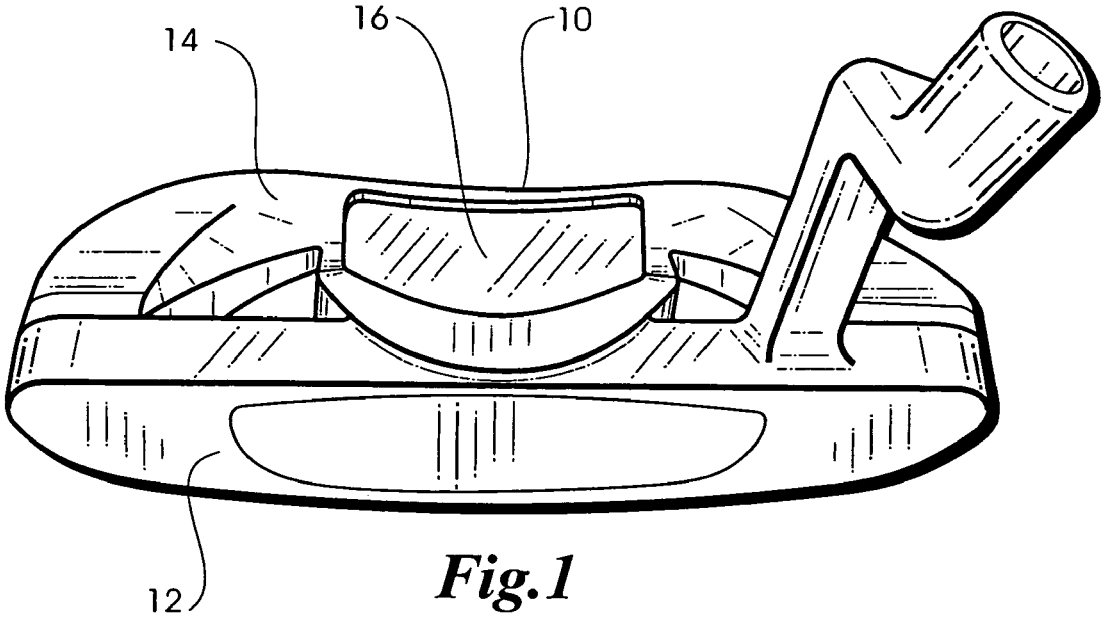
FIG. 1 is a perspective view of a golf putter head with an alignment guide according to the present invention.
Figure 2:
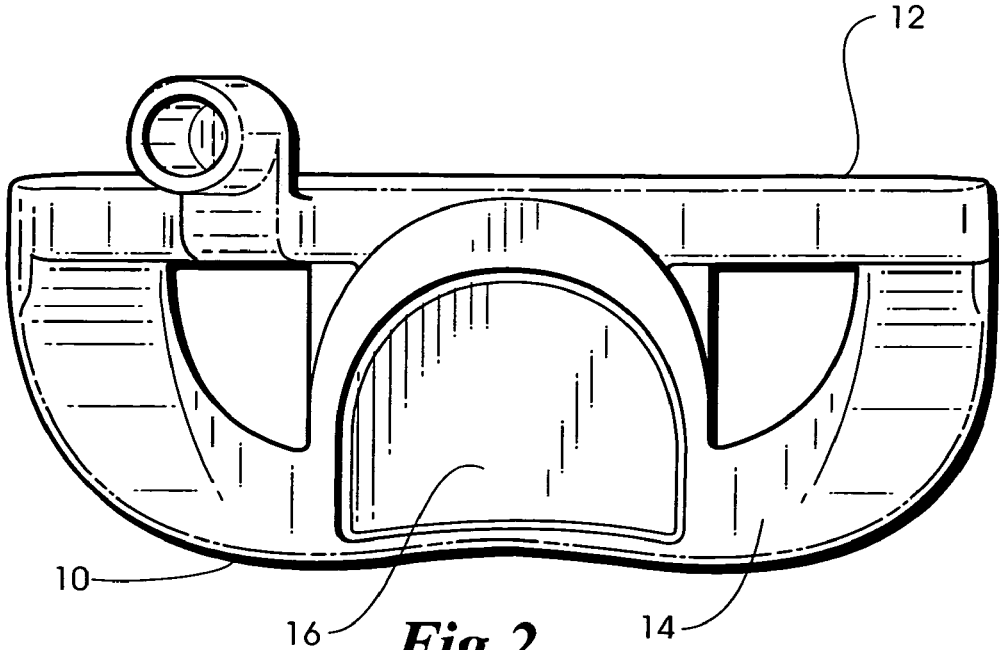
FIG. 2 is a top plan view of the golf putter head of FIG. 1.

With reference to FIG. 1, a golf putter head 10 is preferably made of metal such as stainless steel, titanium, titanium alloys, carbon steel, bronze, and the like. In accordance with one embodiment of the present invention, the putter club head 10 includes a body 11 having a face member 12 and a flange member 14 extending rearwardly from the face member 12. The face member 12 has a front surface arranged for impacting a golf ball. The flange member 14 has an upper surface with a cavity 16 formed therein. As illustrated in FIG. 2, the cavity 16 has a generally semicircular shape with its diameter approximating that of a golf ball.

Figure 3:
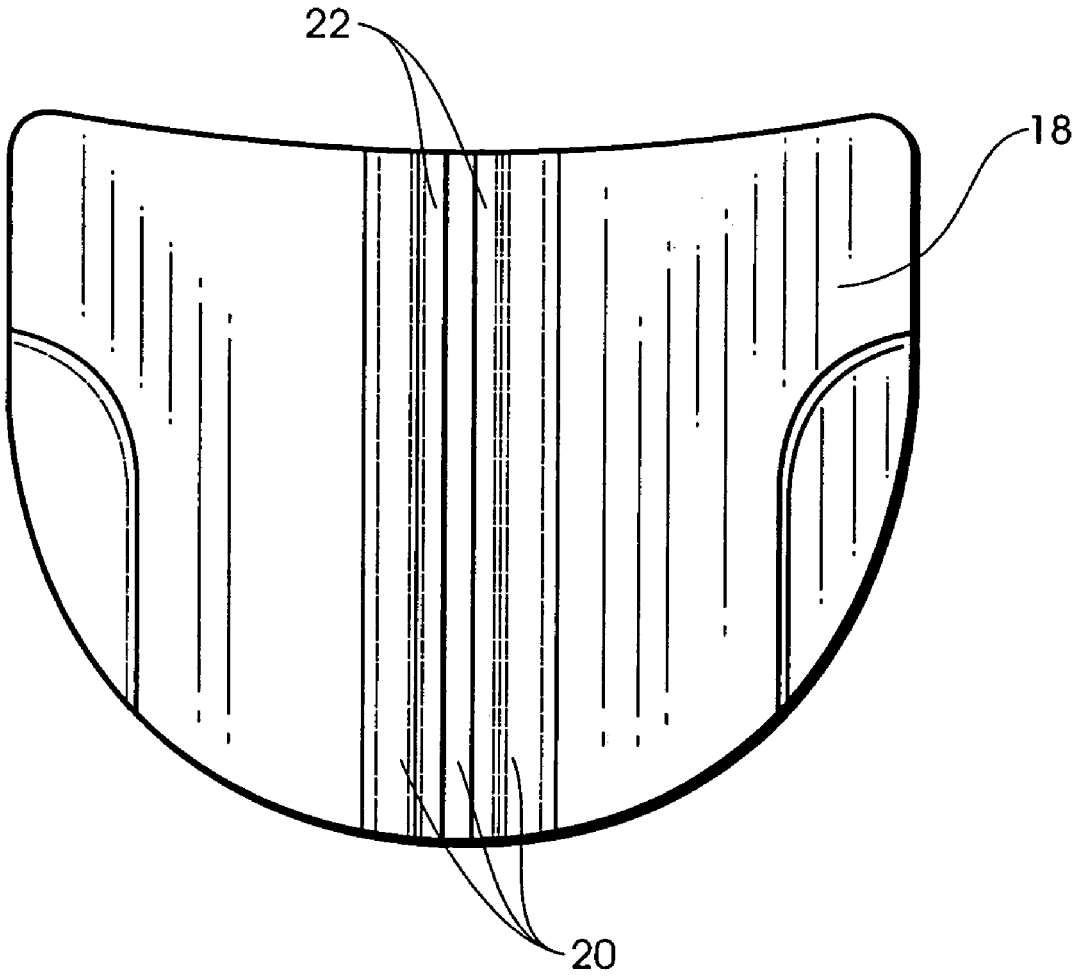
FIG. 3 is a top view of the alignment guide.

As illustrated in FIG. 3, the alignment guide or insert 18 has substantially parallel grooves 20 and substantially parallel ridges 22 on its top surface. The alignment guide or insert 18 has a generally semicircular configuration that matches the generally semicircular shape of the cavity 16. The insert 18 is secured in the cavity 16 in a predetermined orientation so that the grooves 20 and ridges 22 are perpendicular to the front surface of the face member 12. The insert 18 is preferably made of a color that contrasts with the putter head 10.

Figure 4:
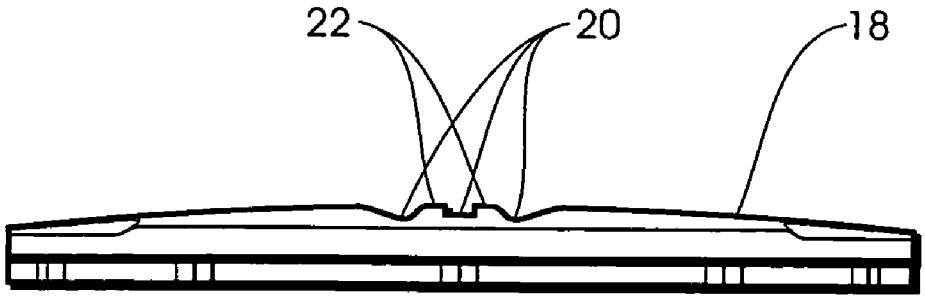
FIG. 4 is a cross-sectional view of the alignment guide shown in FIG. 3.

FIG. 4 illustrates the three-dimensional aspect of the top surface of the insert 18. The parallel grooves 20 are separated by the parallel ridges 22. The grooves 20 preferably have a concave profile while the ridges 22 have a convex profile. The grooves 20 reflect ambient light differently from the ridges 22 thus ensuring easily recognizable contrast zones between the grooves 20 and the ridges 22. These contrast zones define parallel lines perpendicular to the front surface of the face member 12 thereby providing accurate alignment references which are highly visible to a golfer in various lighting conditions.

The insert 18 may be permanently mounted in the cavity 16 by using an adhesive such as epoxy. Alternatively, the insert 18 may be removably mounted in the cavity 16 by using threaded fasteners.

The present invention may also provide a plurality of inserts 18 of different weights and different visual characteristics. Inserts of different weights may be provided by varying the thickness of the inserts or the density of the material used to form the inserts. As illustrated in FIG. 2, since the cavity 16 is located near the center of gravity of the putter head 10, the putter head center of gravity will not change significantly when selecting and installing any of the plurality of inserts.

Although the preferred embodiment of the insert 18 is shown in the putter head 10, other embodiments of inserts could be made for use with wood heads and iron heads.

What is claimed is:

1. A golf club head comprising:

a body having a face member and a flange member extending rearwardly from the face member, the face member including a front surface arranged for impacting a golf ball, the flange member having an upper surface with a cavity formed therein, said cavity having a generally semicircular shape adjacent said face member; and an insert disposed in the cavity in said flange member, said insert having a plurality of substantially parallel grooves separated by a ridge, the insert being oriented in the cavity so that the grooves and the ridge are perpendicular to the face member front surface, the insert having a generally semicircular shape adjacent said face member corresponding to said generally semicircular shape of said cavity.

2. The golf club head according to claim 1, wherein the cavity is located along the approximate center of gravity of the body.

3. The golf club head according to claim 1, wherein the insert is selected from a plurality of inserts.

4. The golf club head according to claim 3, wherein the inserts have different weights.

5. The golf club head according to claim 3, wherein the inserts have different visual characteristics.

6. The golf club head according to claim 1, wherein the insert is permanently mounted in the cavity.

7. The golf club head according to claim 6, wherein the insert is removably mounted in the cavity.

8. The golf club head according to claim 1, wherein the insert has a plurality of substantially parallel ridges separating said plurality of substantially parallel grooves.

9. The golf club head according to claim 1, wherein said body further comprises a generally C-shaped wall extending from said face member into said flange member defining the generally semicircular shape of said cavity.

10. The golf club head according to claim 9, wherein the generally semicircular shape of the insert lies adjacent the generally C-shaped wall.

* * * * *